United States Patent [19]

Nishikawa et al.

[11] Patent Number: 5,035,226

[45] Date of Patent: Jul. 30, 1991

[54] ENGINE CONTROL SYSTEM

[75] Inventors: Seiichirou Nishikawa, Anjo; Kenichiro Kamai, Kariya, both of Japan

[73] Assignee: Nippondenso Co., Ltd., Kariya, Japan

[21] Appl. No.: 462,402

[22] Filed: Jan. 9, 1990

[30] Foreign Application Priority Data

Jan. 16, 1989 [JP] Japan ..... 1-8083

[51] Int. Cl.[5] ..... F02D 41/02

[52] U.S. Cl. ..... 123/494; 123/412; 73/117.3

[58] Field of Search ..... 123/494, 412; 73/117.3, 73/115

[56] References Cited

U.S. PATENT DOCUMENTS

| | | | |
|---|---|---|---|
| 4,332,226 | 6/1982 | Nomura et al. | 123/494 |
| 4,416,239 | 11/1983 | Takase et al. | 123/494 |
| 4,475,381 | 10/1984 | Nakatomi et al. | 73/115 |
| 4,501,250 | 2/1985 | Omori et al. | 123/486 |
| 4,787,043 | 11/1988 | Zimmerman et al. | 123/412 |

FOREIGN PATENT DOCUMENTS

| | | |
|---|---|---|
| 55-109756 | 8/1980 | Japan . |
| 56-96132 | 8/1981 | Japan . |
| 57-32059 | 2/1982 | Japan . |
| 57-104835 | 6/1982 | Japan . |
| 58-158345 | 9/1983 | Japan . |
| 61-185647 | 8/1986 | Japan . |

*Primary Examiner*—Andrew M. Dolinar

*Attorney, Agent, or Firm*—Cushman, Darby & Cushman

[57] ABSTRACT

An engine control system comprises a circuit for selecting a first engine controlled variable or a second engine controlled variable according to engine condition, changeover value for introducing to a pressure sensor the atmospheric pressure when the circuit selects the first engine controlled variable and the negative suction pressure when the circuit selects the second engine controlled variable, an engine control circuit for controlling the engine on the basis of a selected engine controlled variable and the atmospheric pressure and a delay circuit for making the selecting circuit to select the second engine controlled variable after a predetermined time period from the time when the pressure to be introduced to the pressure sensor is changed over from the atmospheric pressure to the negative suction pressure.

13 Claims, 10 Drawing Sheets

IGNITION COIL
SOLENOID VALVE
POWER AMPLIFIER
POWER AMPLIFIER
POWER AMPLIFIER
ROM
RAM
MPU
COUNTER FOR IGNITION TIMING CONTROL
COUNTER FOR FUEL INJECTION TIME CONTROL
OUTPUT PORT
INTERRUPTION CONTROLLER
COUNTER
DIGITAL INPUT PORT
A/D CONVERTER
G1
G2
Ne
A/F SENSOR
PRESSURE SENSOR
THROTTLE VALVE POSITION SENSOR

ENGINE CONTROL SYSTEM

FIELD OF THE INVENTION AND RELATED ART STATEMENT

The present invention relates to an engine control system for controlling a fuel injection rate, an ignition timing, an exhaust gas recirculation (EGR) quantity or the like of an engine Any change in atmospheric pressure results in a change of an air fuel ratio of an engine. It is therefore general to detect the atmospheric pressure by means of an atmospheric pressure sensor in the conventional engine control system. There have been proposed engine control systems of the type that the atmospheric pressure is introduced to a pressure sensor for detecting the negative suction pressure so as to enable both the negative suction pressure and the atmospheric pressure to be detected by a single pressure sensor (as disclosed in, for example, Japanese Patent Unexamined Publication Nos. 57-32059, 57-104835 (U.S. Pat. No. 4,475,381) and 61-185647).

On the other hand, there has also been proposed an engine control system which adopts both a D-J process according to which a standard fuel injection rate is operated by making use of the negative suction pressure and the speed of the engine, and an $\alpha N$ process according to which it is operated by making use of the throttle opening degree and the speed of the engine (as disclosed in Japanese Patent Unexamined Publication No. 56-96132 (U.S. Pat. No. 4,332,226), for example).

However, in a system combining the former conventional system with the latter, the atmospheric pressure is detected by means of the pressure sensor for detecting the negative suction pressure when it does not to detect the negative suction pressure of the engine. When the operating condition is suddenly changed so that the pressure sensor detects the negative suction pressure while the atmospheric pressure is being detected by such pressure sensor, it is attempted to change over a solenoid valve at once so as to introduce the negative suction pressure to the pressure sensor. However, this causes a time delay between the time when the negative suction pressure is introduced to the pressure sensor and the time when it can be detected, so that the atmospheric pressure remaining in the pressure sensor immediately after changing over the solenoid valve is misdetected as the negative suction pressure, thus giving rise to a problem of inaccuracy of the controllability of the engine.

OBJECT AND SUMMARY OF THE INVENTION

Accordingly, an object of the present invention is to improve the controllability of an engine by eliminating any disadvantage attributable to misdetection of an atmospheric pressure as a negative suction pressure by the pressure sensor even if the operating condition is suddenly changed to detect the negative suction pressure on the detection of the atmospheric pressure.

To this end, according to the present invention, there is provided an engine control system which comprises means for detecting a throttle opening degree of an engine, means for detecting a speed of the engine, means for detecting a pressure, first operating means for operating a first engine controlled variable on the basis of a throttle opening degree signal from the throttle opening degree detection means and a speed signal from the speed detection means, second operating means for operating a second engine controlled variable on the basis of a negative suction pressure signal from the pressure detection means and the speed signal from the speed detection means, means for selecting the first engine controlled variable or the second engine controlled variable according to engine conditions, suction pressure/ atmospheric pressure changeover means for introducing to the pressure detection means the atmospheric pressure when the selection means selects the first engine controlled variable and the negative suction pressure when the selection means selects the second engine controlled variable, means for detecting atmospheric pressure based on the output from the pressure detection means to which the atmospheric pressure is introduced by means of the changeover means, means for controlling the engine on the basis of the first or the second engine controlled variable selected by the selection means and the atmospheric pressure detected by the atmospheric pressure detection means; and delay means making the selection means to select the second engine controlled variable after the selection means has been made to continue to select the first engine controlled variable for a predetermined time period from the time when the pressure to be introduced to the pressure detection means is changed over from the atmospheric pressure to the negative suction pressure by means of the suction pressure/ atmospheric pressure changeover means.

The selection means may include means for gradually changing an engine controlled variable from the first engine controlled variable to the second engine controlled variable.

In addition, the throttle opening degree detection means may be replaced by means for detecting the quantity of suction air to be sucked into the engine.

With the above-described arrangement, the throttle opening degree of the engine is detected by the throttle opening degree detection means, and the speed of the engine is detected by the speed detection means. The first engine controlled variable is operated by the first operating means on the basis of the throttle opening degree signal from the throttle opening degree detection means and the revolution number signal from the revolution number detection means, and the second engine controlled variable is operated by the second operating means on the basis of the negative suction pressure signal from the pressure detection means and the speed signal from the speed detection means. The selection means selects the first engine controlled variable or the second engine controlled variable according to the engine conditions. The suction pressure/atmospheric pressure changeover means operates to introduce to the pressure detection means the atmospheric pressure when the selection means selects the first engine controlled variable and the negative suction pressure when the selection means selects the second engine controlled variable. The atmospheric pressure is detected by the atmospheric pressure detection means on the basis of the output from the pressure detection means to which the atmospheric pressure is introduced by means of the changeover means. The engine control means controls the engine on the basis of the first or the second engine controlled variable selected by the selection means and the atmospheric pressure detected by the atmospheric pressure detection means, and the delay means makes the selection means to select the second engine controlled variable after the selection means has been made to continue to select the first engine controlled variable for a predetermined time period from the time when the pressure to be introduced to the pressure detection means is changed over from the atmospheric pressure to the negative suction pressure by means of the suction pressure/atmospheric pressure changeover means.

The change of engine controlled variable from the first engine controlled variable to the second engine controlled variable may be executed gradually by the change means.

Further, the quantity of suction air to be sucked into the engine may be, detected by the suction air quantity detection means 10'(FIG. 2A), instead of the throttle opening degree detection means.

DESCRIPTION OF THE PREFERRED EMBODIMENTS

Figure 1:
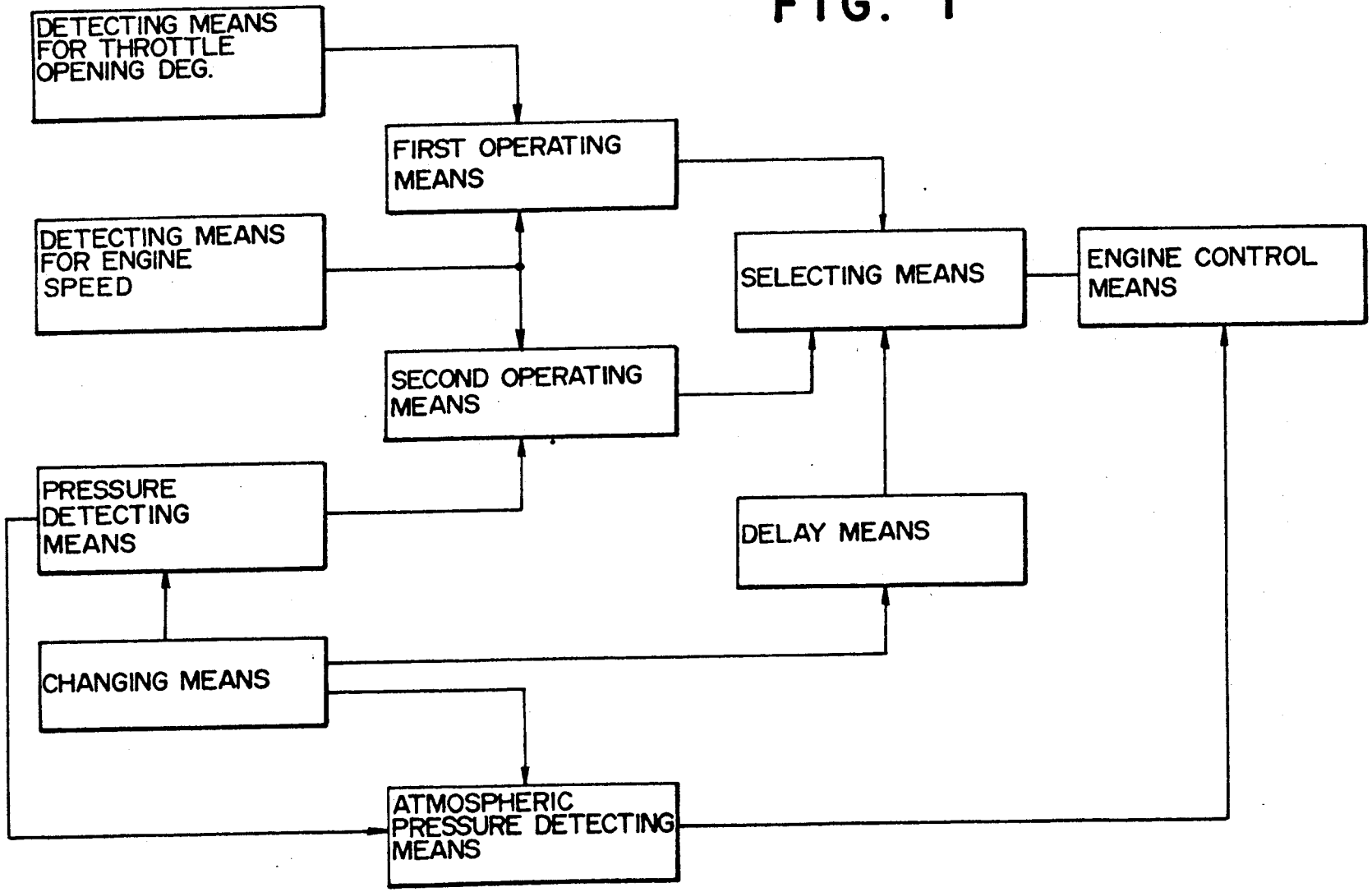
FIG. 1 is a block diagram illustrating a control system in correspondence to the invention.

A control system according to a preferred embodiment of the present invention shown in FIG. 1 will be described hereinunder with reference to FIGS. 2 to 9B.

Figure 2:
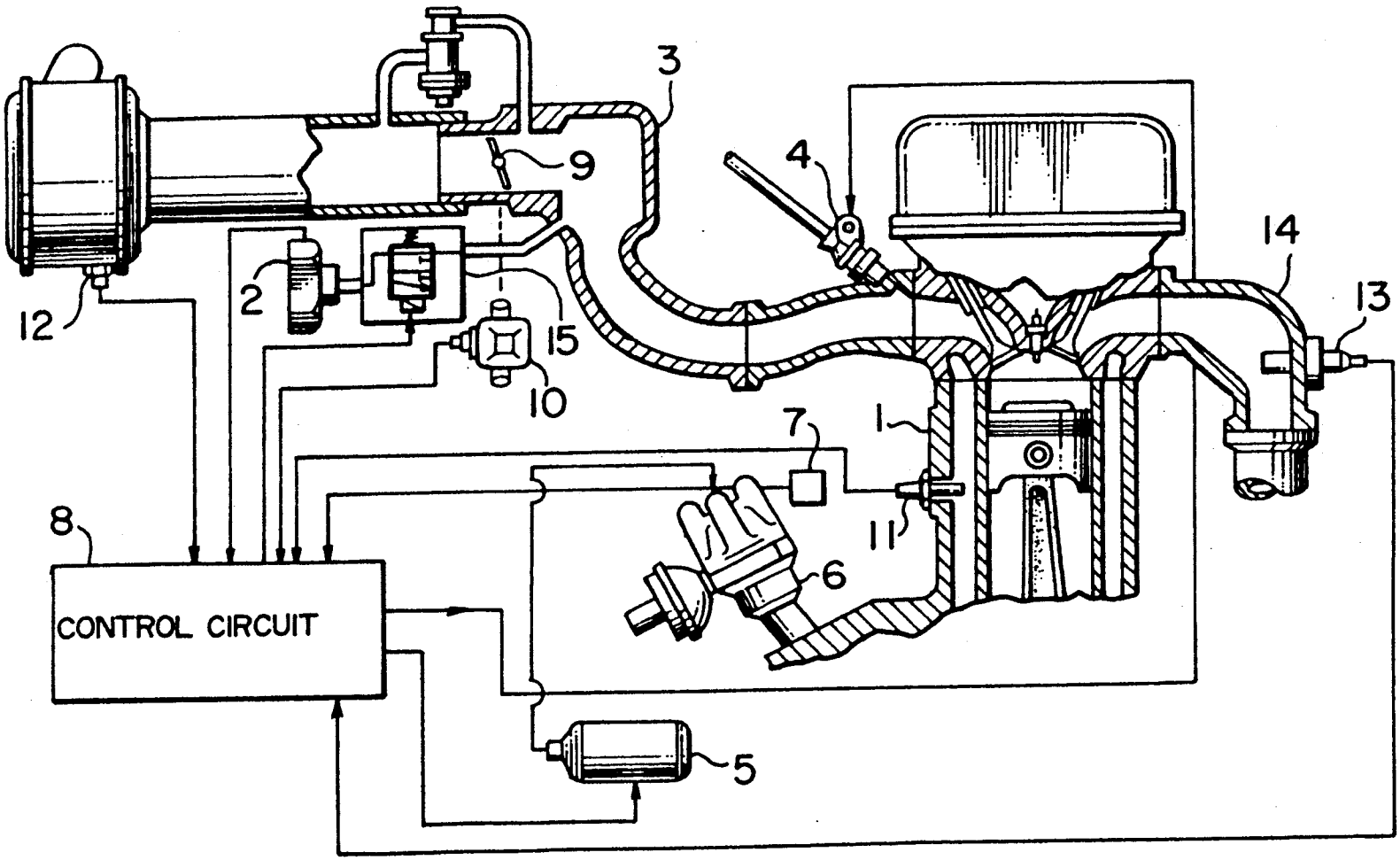
FIG. 2 is a partly sectional view of an engine system to which an embodiment of the system according to the present invention.
Figure 2A:
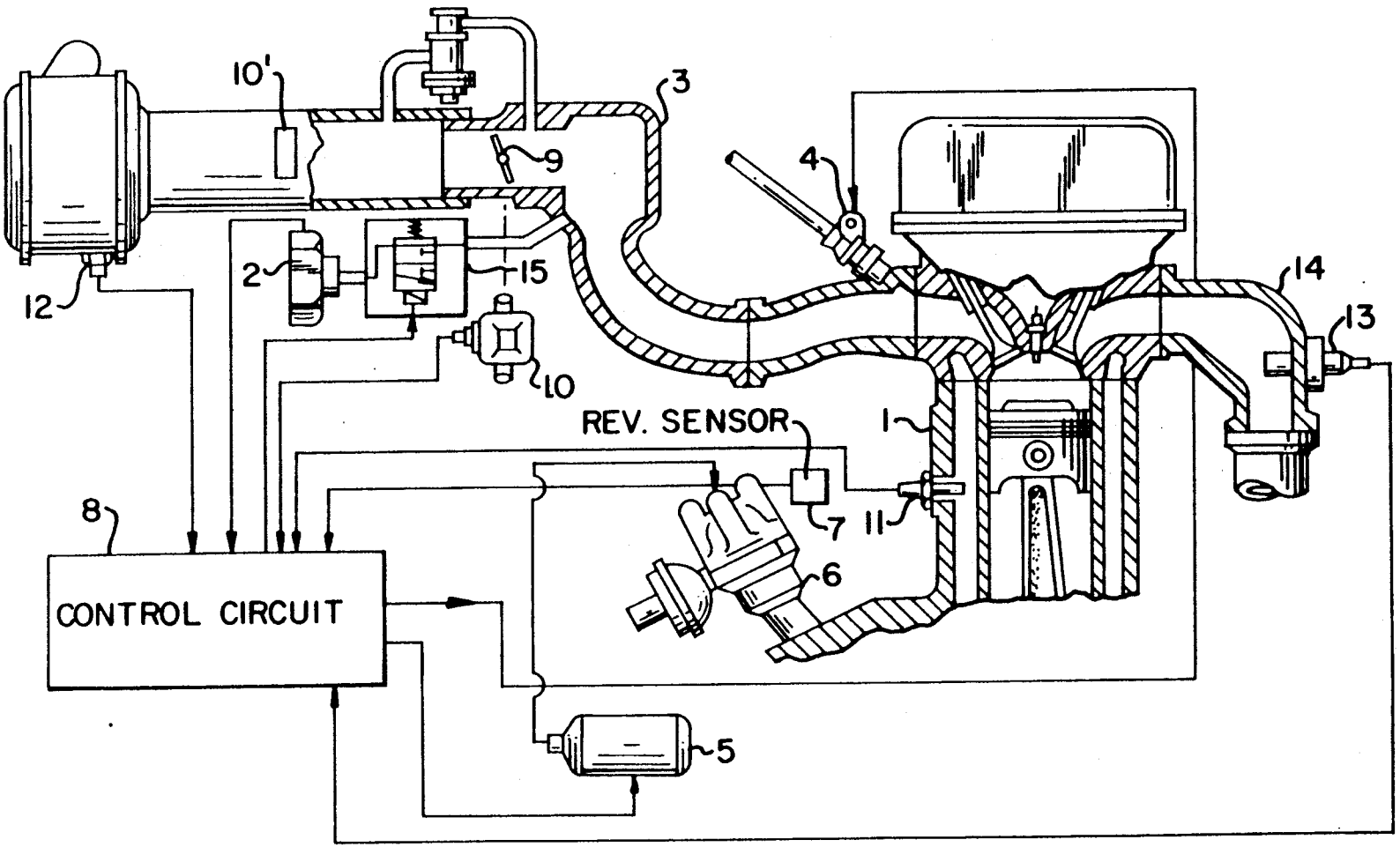
FIG. 2A is a partly sectional view of an engine system of another embodiment of the system according to the present invention.

Referring to FIG. 2, an internal combustion engine to which the control system is applied has six cylinders 1. A pressure sensor 2 is provided for detecting the suction air pressure in an intake pipe 3 connected to the cylinder 1 or the atmospheric pressure. The pressure sensor 2 is constituted by a semiconductor pressure sensor. A solenoid controlled valve 4 for fuel injection is provided in a portion of the intake pipe 3 adjacent to an intake port of the cylinder 1. An igniter includes an ignition coil 5 and a distributor 6 connected to the ignition coil 5. The distributor 6 has a rotor which is rotatively driven at a number of revolutions equal to a half of that of the engine. The distributor 6 incorporates a revolution sensor unit 7 which outputs signals representing the speed of the engine and the fuel injection timing as well as a cylinder discrimination signal. A throttle valve 9 is provided within the intake pipe 3. A throttle position sensor 10 detects an opening degree of the throttle valve 9. A thermistor type sensor 11 is provided in the cylinder 1 to detect a temperature of cooling water of the engine. A sensor 12 is provided to detect a temperature of the suction air. A sensor 13 is provided in an exhaust manifold 14. The sensor 13 detects an air-fuel ratio on the basis of the concentration of oxygen in the exhaust gas in the exhaust manifold 14. The air-fuel ratio sensor 13 outputs a signal representing the detected air-fuel ratio, e.g., a voltage signal of about 1 volt when the detected air fuel ratio is rich as compared with the theoretical air fuel ratio while another voltage signal of about 0.1 volt when lean. A solenoid valve 15 is disposed between the pressure sensor 2 and the intake pipe 3. The solenoid valve 15 is a three-way valve which selectively communicates the pressure sensor 2 with the intake pipe 3 or the atmosphere in accordance with a control signal from a control circuit 8.

The control circuit 8 further serves to control the fuel injection rate of the engine in accordance with the engine operating condition so as to control the airfuel ratio. The circuit 8 is constituted by a microcomputer. The control circuit 8 takes the respective detection signals from the pressure sensor 2, the revolution sensor unit 7, the throttle position sensor 10, the water temperature sensor 11, the suction air temperature sensor 12, and the air-fuel ratio sensor 13. The circuit 8 calculates a fuel injection rate on the basis of the detection data thus taken in, and then controls the valve opening duty time of the fuel injection valve 4, thus performing the air-fuel ratio control.

Figure 3:
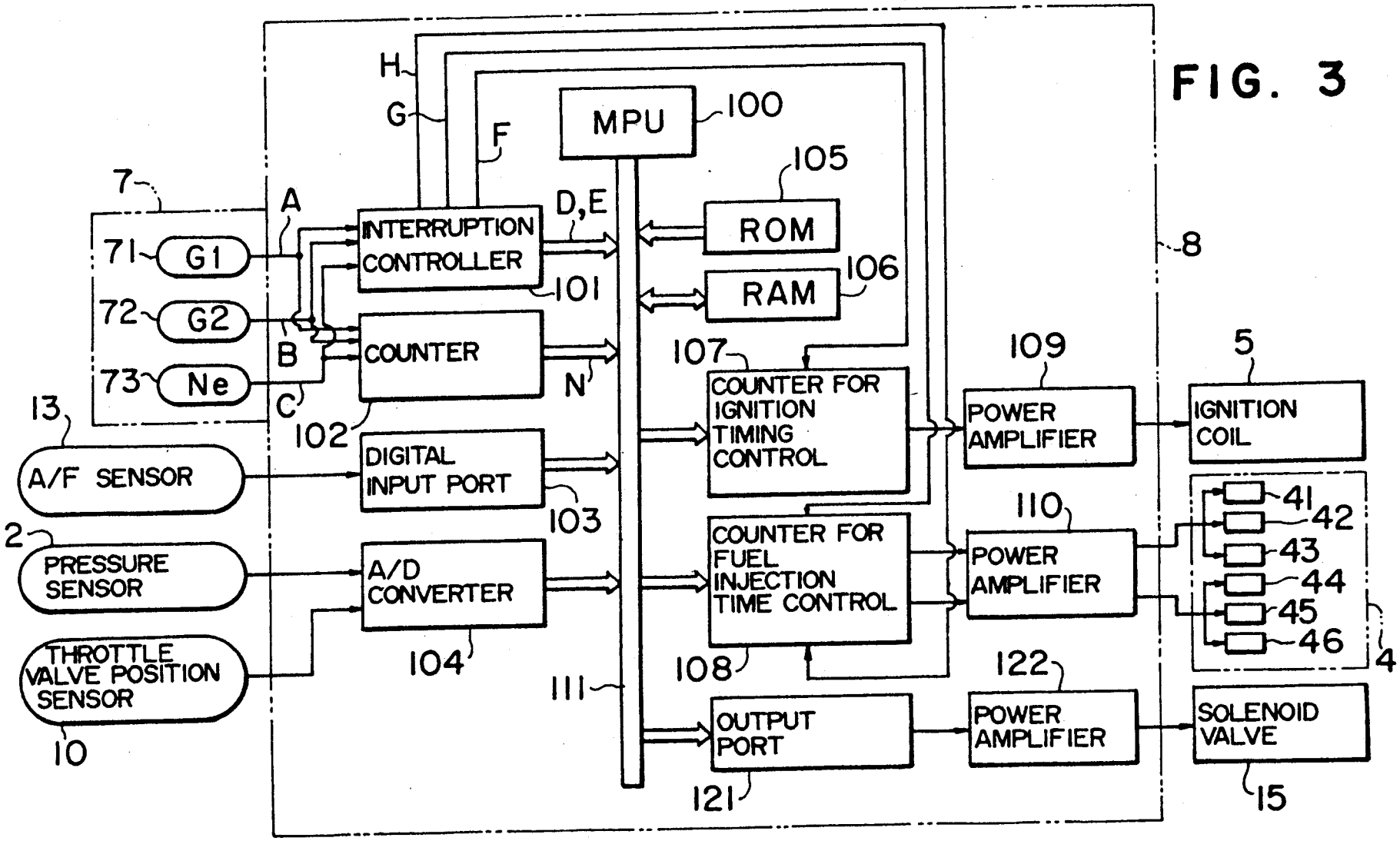
FIG. 3 is a block diagram of the control system shown in FIG. 2.
Figure 4:
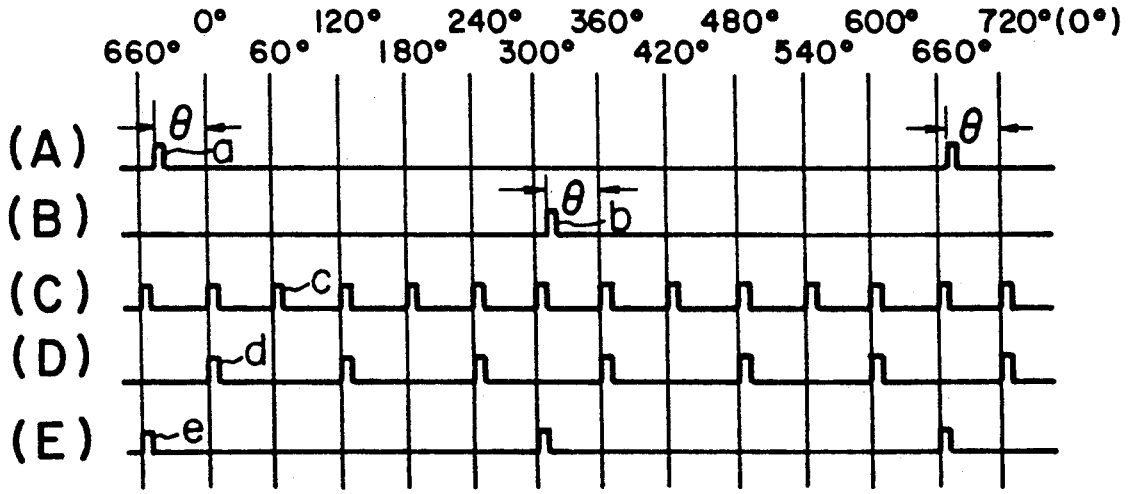
FIG. 4 is a timing chart of angle signal from a revolution sensor unit.

Referring to FIG. 3, the control circuit 8 includes an MPU (Micro Processing Unit) 100 for executing the calculation processing in accordance with a predetermined program, an interruption controller 101 for outputting an interrupt signal to the MPU 100, a counter 102 for counting the revolution angle signals from the revolution sensor unit 7 and for calculating the speed of the engine, a digital input port 103 for receiving a detection signal from the air-fuel ratio sensor 13, and an A/D converter 104 which receives the detection signals (analog signals) from the pressure sensor 2 and the throttle position sensor 10 and converts them into digital signals. A ROM 105 is a read-only memory in which map data used for programs and operations and other like are stored in advance. A RAM 106 is a read/write nonvolatile memory which preserves the stored data even after a key switch is turned off. The circuit 8 further includes an output counters 107 and 108. The counter 107 for outputting ignition timing control signal includes a register and receives data on the ignition timing computer by the MPU 100 and outputs the ignition timing control signal in accordance with the crank angle. The counter 108 for outputting fuel injection rate (time) control signal includes a register. The counter 108 receives data on the fuel injection rate from the MPU 100, and determine the duty ratio of control pulse signal controlling the valve opening time of the fuel injection valve 4 on the basis of the received data, and outputs the injection rate control signal. The control signals from the output counters 107 and 108 are supplied through power amplifiers 109 and 110 to the ignition coil 105 and the fuel injection valves 4 of the respective cylinders, respectively. An output port 121 outputs a drive signal sent from the MPU 100 so as to change over the solenoid valve 15 from the intake pipe 3 side to the atmosphere side. This drive signal is supplied through a power amplifier 122 to the solenoid valve 15. In the control circuit 8, the MPU 100, the interrupt controller 101, the input counter 102, the digital input port 103, the A/D converter 104, the ROM 105, the RAM 106, the output counters 107, 108, and the output port 121 are separately connected to a common bus 111. The data are transferred therebetween in accordance with the commands from the MPU 100.

The revolution sensor unit 7 has three sensors 71, 72 and 73. The first revolution sensor 71 generates an angular pulse a each time the distributor 6 makes a one revolution, that is, each time the crank shaft rotates fully twice (or through 720°), at a point backward of the point of crank angle 0° by a predetermined angle $\theta$, as shown in a timing chart A in FIG. 4. The second revolution sensor 72 generates an angular pulse b each time the crank shaft rotates fully twice at a point backward of the point of crank angle 360° by the predetermined angle $\theta$ (a timing chart B in FIG. 4). The third revolution sensor 73 generates at regular intervals angular pulses the number of which is equal to the number of cylinders each time the crank shaft makes a one revolution e.g it generates six angular pulses c at intervals of 60° starting from the point of crank angle 0° in the case of a six cylinder engine (a timing chart C in FIG. 4).

The interrupt controller 101 receives these angular pulses from the revolution sensor unit 7, and outputs a signal, the frequency of which is reduced to a half of that of the angular pulse c of the third revolution sensor 73, to the MPU 100 as interrupt command pulse d. The command pulse d homologize the angular pulse c immediately after the angular pulse a. On receiving the interrupt pulse d, the MPU 100 executes the operation routine for the ignition timing control (a timing chart D in FIG. 4). The interrupt controller 101 also outputs a signal obtained by reducing the frequency of the angular pulse c of the third revolution sensor 73 to one sixths to the MPU 100 as interrupt command pulse e, every sixth pulse c after sending the angular pulse a of the first revolution sensor 71 and the angular pulse b of the second revolution sensor 72, that is, every 360° starting from the point of crank angle 300°. The interrupt command pulse e makes the MPU 100 calculate the fuel injection rate.

Figure 5:
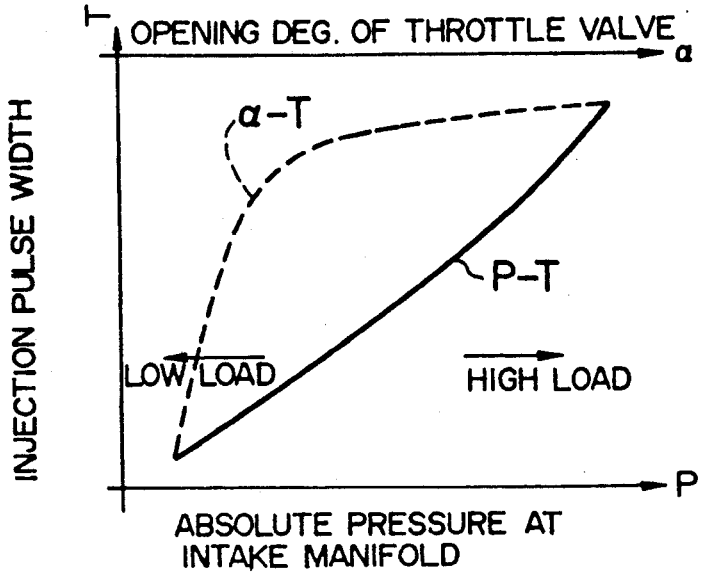
FIGS. 5 to 7 are characteristic views for use in explanation of operation of the system shown in FIG. 2.
Figure 6:
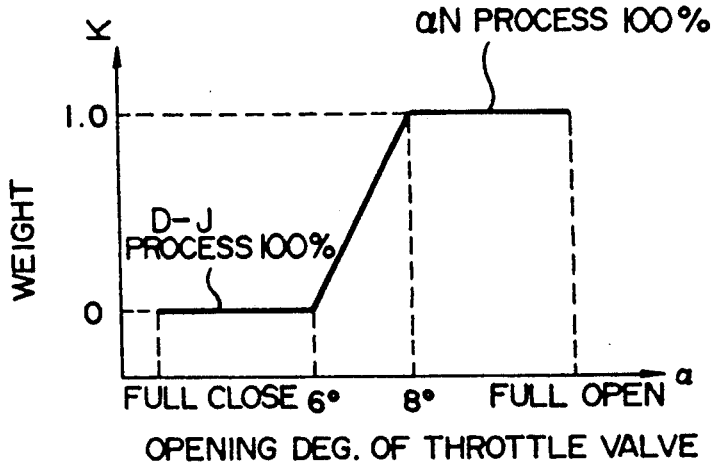

Next, operation of the above-described arrangement will be described. The fundamental structure of the present invention employs both the D-J process according to which the standard fuel injection rate is computed based on the negative suction pressure of the engine and the speed of the engine, and the $\alpha$N process according to which the standard fuel injection rate is computed on the basis of the throttle opening degree of the engine and the speed of the engine, like the system of Japanese Patent Unexamined Publication No. 56-96132 (U.S. Pat. No. 4,332,226). Considering one engine speed, the injection pulse is shown in FIG. 5 as a curve $\alpha$-T ($\alpha$N process) and a curve P-T (D-J process). If the control is carried out in accordance with the $\alpha$N process over the entire range of the engine speed, the fuel rate responds sensitively to the throttle opening degree, that is, to the operation of an accelerator pedal, so that the responsiveness of the engine is excellent. However, air which bypasses the throttle (e.g., supplementary air for fast idling) cannot be detected, with the result that the discrepancy of A/F is increased in light load condition in which the bypass air occupies a great part of the whole suction air. For this reason, control is carried out in accordance with the D-J process in light load condition. FIG. 6 shows a weighting function, by which a fuel injection pulse width W combining an injection pulse width $W_{DJ}$ obtained by the D-J process and an injection pulse width $W_{\alpha N}$ obtained by the $\alpha$N process is determined as follows.

$$W=(1-K)\times W_{DJ}+K\times W_{\alpha N}$$

Namely, since the weighting function K is within a range between the throttle full closed position in which the throttle opening degree is 0° and the position in which the throttle opening degree is 6° is zero, the injection pulse width W is therefore equal to the injection pulse width $W_{DJX}$ ($W=W_{DJ}$). While the weight function K in the position in which the throttle opening degree is 8° or more is 1, so that the injection pulse width W is therefore equal to the injection pulse width $W_{\alpha N}$. *Between* 6° and 8°, the injection pulse width W is determined by combining the weighted injection pulse width and $W_{DJ}$ and $W_{\alpha N}$ in according to the throttle opening degree ($W=(1-K)\times W_{DJ}+K\times W_{\alpha N}$).

Incidentally, instead of computing the standard fuel injection rate on the basis of the throttle opening degree of the engine and the speed of the engine, such fuel injection rate may be computed on the basis of the speed of the engine and the amount of suction air to be introduced into the engine, which is detected by suction air detection means.

The method for obtaining the atmospheric pressure will be described briefly hereinunder.

When it is determined that the throttle opening degree is in the $\alpha$N process control range, namely it is 8° or more, the control circuit 8 sends a command to the solenoid valve 15 to introduce the atmosphere to the pressure sensor 2. A little while after the solenoid valve 15 is changed over to the atmosphere introduction side, the atmospheric arrives at the pressure sensor 2 in a stable manner and at that time the output of the pressure sensor 2 is taken in as the atmospheric pressure. Immediately after the completion of this taking-in, negative manifold pressure is introduced to the pressure sensor 2. In this case, since the atmospheric pressure is changed in accordance with the running on the up- and downslopes, it is enough to detect atmospheric pressure once at intervals of several seconds to several minutes. It is assumed here that the throttle is closed to a degree of 5° shown in FIG. 6 while the atmospheric pressure is being detected by the $\alpha$N process (or while the solenoid valve 15 is being communicated with the atmosphere side). In this case, it is natural to control the injection rate by making use of the negative suction pressure in the intake manifold. However, the atmosphere is already introduced to the pressure sensor 2. Accordingly, even if the solenoid valve 15 is changed to the manifold side, the pressure sensor 2 cannot receive the negative suction pressure immediately, resulting in the error of the fuel injection rate.

Figure 7:
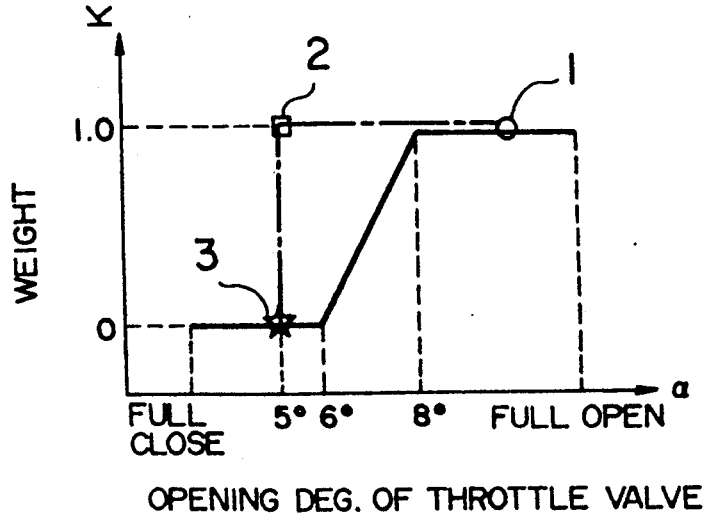

To cope with the above, the following method is used. Immediately after the throttle opening degree is decreased within the D-J process control range (or the throttle is driven towards its closed position) during the detection of the atmospheric pressure, the solenoid valve 15 is changed over so as to introduce the negative suction pressure to the pressure sensor 2. The fuel injection rate is controlled in accordance with the $\alpha$N process for a predetermined period of time (during which the negative suction pressure reaches the pressure sensor 2) after the changeover of the solenoid valve 15, and thereafter is controlled in accordance with the D-J process. Namely, as shown in FIG. 7, if the atmospheric pressure has not been detected at a point ① in the operating condition in accordance with the $\alpha$N process, the fuel injection rate is determined in accordance with the D-J process at once as shown at a point ③. However, if the atmospheric pressure is being detected at the point ① in the operating condition in accordance with the $\alpha$N process, the fuel injection rate is still determined in accordance with the $\alpha$N process until a point ② and, thereafter, it is determined in accordance with the D-J process at a point ③ as indicated by an asterisk mark. Namely, the detection of the negative suction pressure is delayed.

Figure 8:
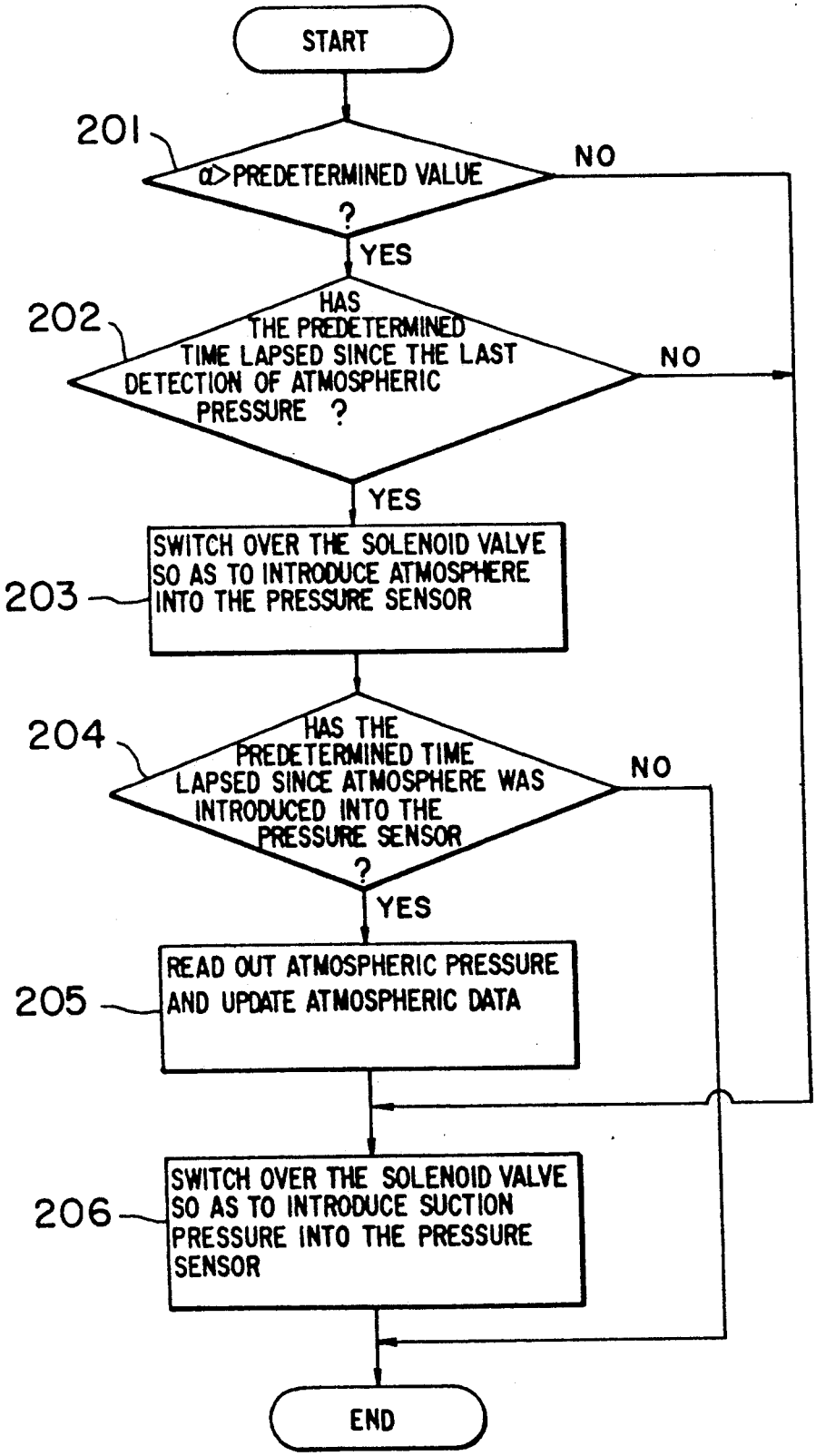
FIGS. 8, 9A, and 9B are flow charts for use in explanation of operation of the system shown in FIG. 2.

FIG. 8 shows a control flow of the taking-in of the atmospheric pressure in a main routine of the control circuit 8. This routine is started periodically together with other control programs. On starting this routine, first of all, it is judged whether or not a detected throttle opening degree $\alpha$ is larger than the predetermined value at step 201. In the example of FIG. 6, the predetermined value is 8°. When the throttle opening degree $\alpha$ is smaller than 8°, the atmospheric pressure is not taken in, so that the operation proceeds to step 206 at which the negative suction pressure is introduced to the pressure sensor 2. On the other hand, when the throttle opening degree $\alpha$ is larger than 8°, the operation proceeds to step 202 at which it is judged whether or not the predetermined time (on the order of several tens of seconds to several minutes) has elapsed from the last taking-in of the atmospheric pressure. If not, the pressure sensor 2 does not take in the atmospheric pressure but the negative suction pressure (step 206). If it is judged at step 202 that the predetermined time has elapsed, the operation proceeds to step 203 and then the solenoid valve 15 is changed over to the atmospheric pressure introduction side for the purpose of detecting the atmospheric pressure so as to allow the atmospheric pressure to be introduced to the pressure sensor 2. The operation proceeds to step 204. At step 204, if it is judged that a predetermined time (on the order of several tens of seconds) has not elapsed from the time when the atmospheric pressure is introduced to the pressure sensor 2, the routine ends. If it is judged at step 204 that the predetermined time has elapsed, the operation proceeds to step 205 and the signal from the pressure sensor 2 is read in the A/D converter 104 of the control circuit 8 and the read-in value is stored in the RAM 106 as the atmospheric pressure data. Subsequently, at step 206, the solenoid valve 15 is changed over so as to allow the negative suction pressure to be introduced to the pressure sensor 2, thus completing this routine.

Figure 9A:
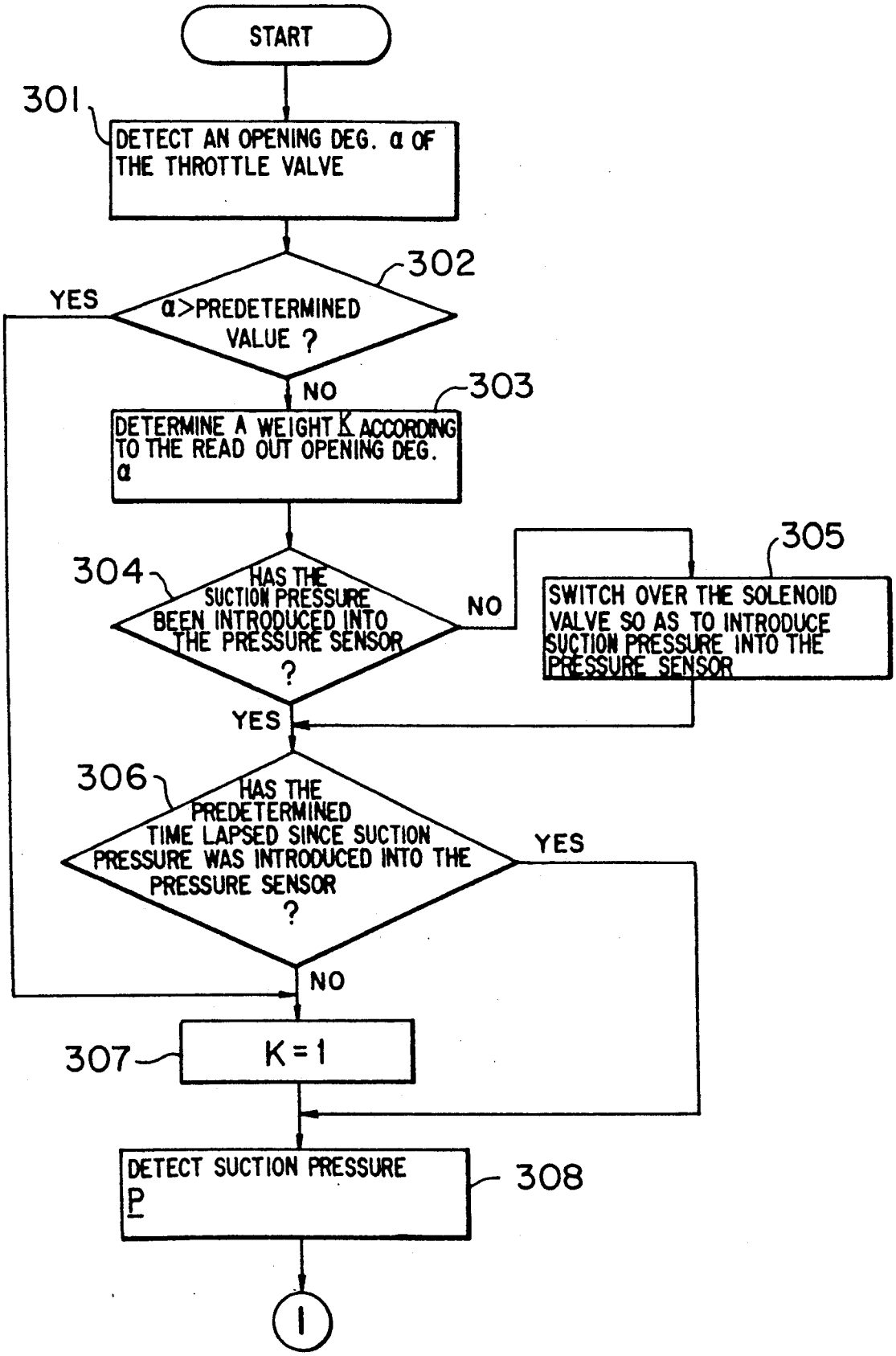
Figure 9B:
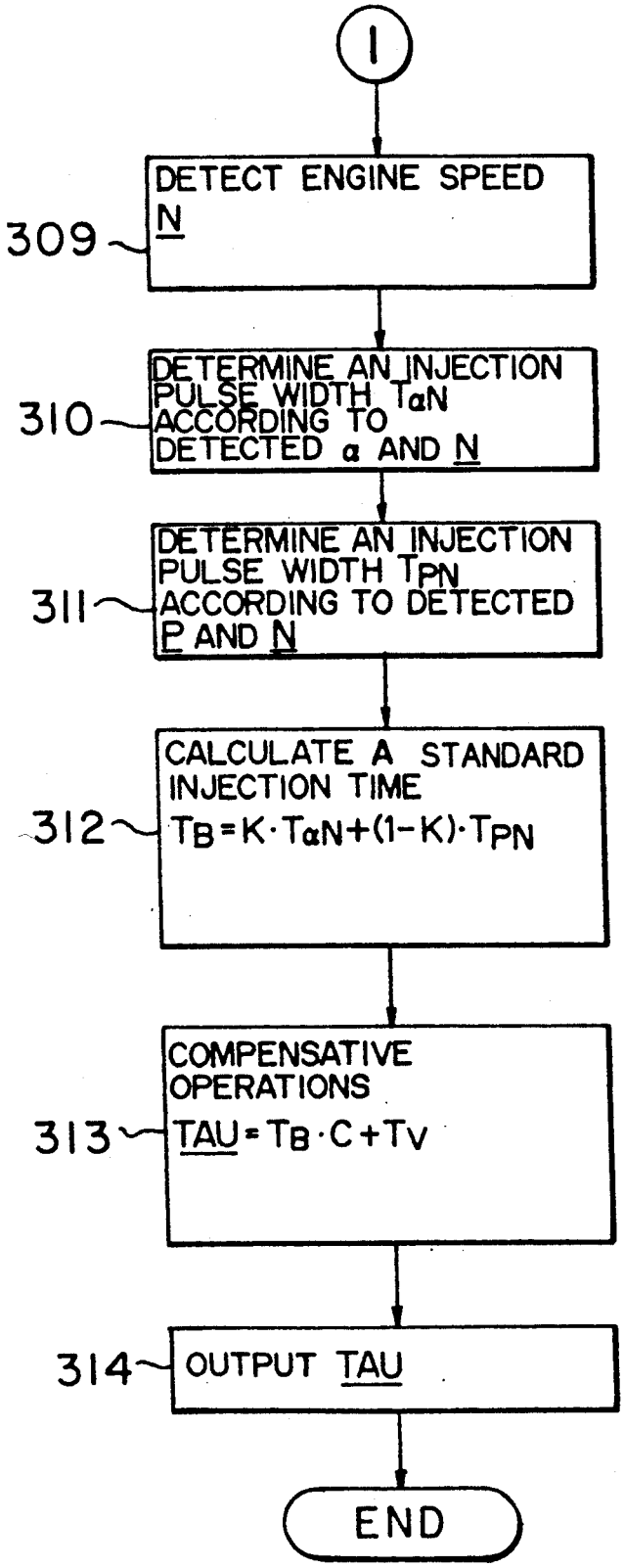

FIGS. 9A and 9B show a control flow of the calculation of the fuel injection pulse width in the interrupt routine of the control circuit 8. First of all, at step 301, a detected throttle opening degree $\alpha$ is taken in predetermined area in the RAM 106 on the basis of the output of the throttle position sensor 10. Then, if it is judged at step 302 that the throttle opening degree $\alpha$ is larger than the predetermined value (8° in the example of FIG. 6), the fuel injection pulse width must be determined in accordance with the $\alpha$N process, so that the operation proceeds to step 307. The weight K is set to be equal to 1 at step 307 and, then, the processing goes on through steps 308 to 313, thereby obtaining the final fuel injection time TAU.

More specifically, the negative suction pressure P is taken in a predetermined area of the RAM 106 on the basis of the output of the pressure sensor 2 at step 308. The speed N of revolutions of the engine is taken in another area of the RAM 106 on the basis of the output of the revolution sensor unit 7 at step 309. Then, at step 310, a standard injection pulse width $T_{\alpha N}$ according to the $\alpha$N process is obtained by retrieving the ROM 105 using $\alpha$ and N, while, at step 311, a standard injection pulse width $T_{PN}$ according to D-J process is obtained by retrieving the ROM 105 using P and N. Based on these $T_{\alpha N}$ and $T_{PN}$ and the weight K, a standard injection time $T_B$ is computed in accordance with a formula $T_B = K \times T_{\alpha N} + (1-K) \times T_{PN}$. Subsequently, at step 313, based on the compensation factor C for water temperature, suction air temperature, transition, air fuel ratio, and atmospheric pressure and the invalid injection time $T_V$ depending upon the battery voltage, the final fuel injection time TAU is computed in accordance with a formula $TAU = T_B \times C + T_V$. Then, at step 314, the value of TAU is set in the TAU control counter 108 of the control circuit 8.

On the contrary, when the throttle opening degree $\alpha$ is smaller than 8° (e.g., 5° as shown in FIG. 7), the weight K corresponding to the throttle opening degree $\alpha$ is obtained on the basis of the weight function shown in FIG. 6 at step 303. In this case, at step 304, it is judged whether or not the negative suction negative suction pressure is being introduced to the pressure sensor 2. When it is judged at step 304 that the atmospheric pressure is introduced to the pressure sensor 2, the operation proceeds to step 305 and then the solenoid valve 15 is changed over so as to allow the negative suction pressure to be introduced to the pressure sensor 2. At the succeeding step 306, it is judged whether or not a predetermined time has elapsed from the time when the suction pressure is introduced to the pressure sensor 2. When it is judged at step 306 that the predetermined time has not elapsed, the negative suction pressure does not reach the pressure sensor 2 satisfactorily so that the injection time is determined in accordance with the $\alpha$N process (i.e. $K=1$). Namely, this state is at the point ② shown in FIG. 7. On the other hand, when it is judged at step 306 that the predetermined time has elapsed, TAU is calculated by making use of the weight K obtained at step 303 on the assumption that the negative suction pressure reaches the pressure sensor 2 satisfactorily, and is then output.

In the above case, in the range of $K<1$, after maintaining the weight K at the point shown in FIG. 7 for the predetermined time period from the time when the negative suction pressure is introduced to the pressure sensor 2, the weight K is suddenly changed from the point ② to the point ③. However, instead of this, it may be possible to change gradually from the point ② to the point ③ (or to change the weight K gradually from 1 to 0). In this case, two steps shown in FIG. 10 will be added to the flow of FIGS. 9A and 9B, that is, step 315 at which it is judged whether or not deviation obtained by subtracting the newly retrieved value of K from the last executed value of K is larger than a preset value $\Delta K$, and step 316 at which a value obtained by subtracting $\Delta K$ from the last executed value of K is set as a new value of K when it is judged that the result of calculation at step 315 is larger than the preset value.

Figure 11:
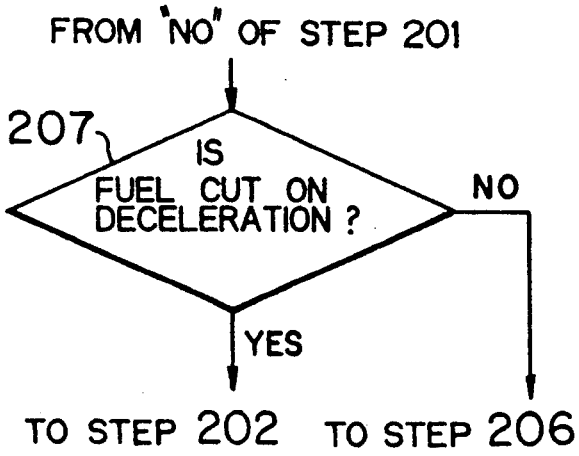

Further, even while cutting the fuel at the time of deceleration in high engine revolution speed operation with the throttle being full closed, it may be possible to change over the solenoid valve 15 to introduce the atmospheric pressure to the pressure sensor 2 so as to detect the atmospheric pressure. In this case, a step 207 shown in FIG. 11 will be added to the flow of FIG. 8. In this case as well, when opening the throttle during detecting operation or when the D-J process is employed to inject fuel due to reduction in the number of revolutions of the engine, the fuel injection time is determined in accordance with the $\alpha$N process (i.e. $K=1$) for a while, and then K is changed instantly or gradually.

In the flow of FIG. 9A, at step 307, K=1 may be replaced by K=0.9. In this case, the substantially same operation can be obtained as with K=1.

In the flow of FIG. 9A as well, at step 306, in place of judging whether or not the predetermined time has elapsed from the time when the negative suction pressure is introduced to the pressure sensor 2, it may be judged whether or not a predetermined number of revolutions of the engine has been reached so as to judge whether or not the predetermined time period has elapsed.

Figure 10:
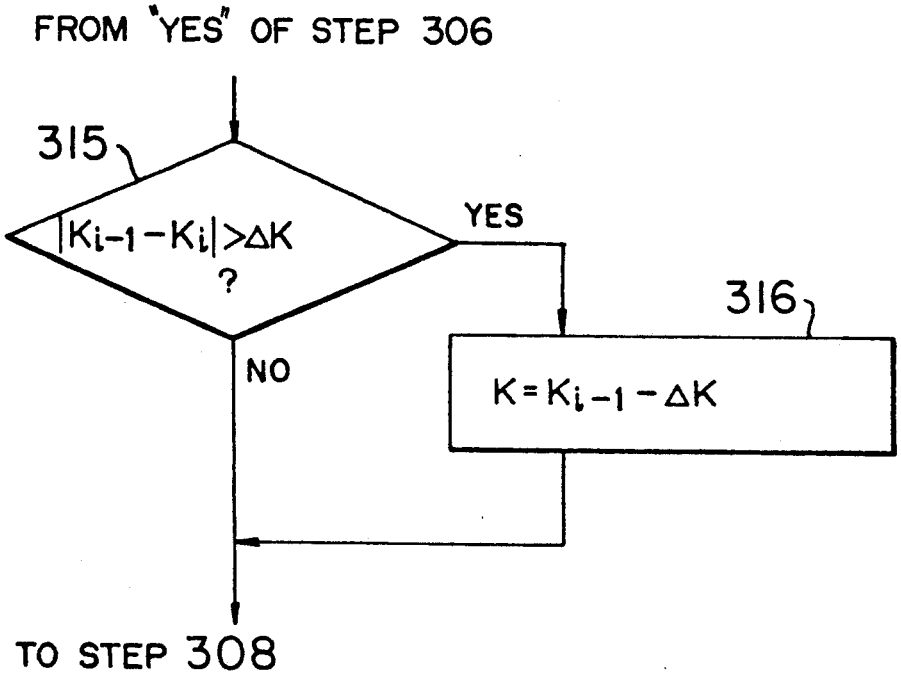
FIGS. 10 and 11 are parts of the flow charts representing operation of systems according to other embodiments of the present invention, respectively.

On the other hand, in the case that the gradually changing steps 315 and 316 shown in FIG. 10 are provided, the step 306 shown in FIG. 9A may be omitted and the operation proceeds from step 304 or 305 directly to the step 315 shown in FIG. 10.

In addition, the present invention is applicable not only to the fuel injection control but also to other engine controls such as the ignition timing control and the EGR control.

As has been described above, according to the present invention, therefore, it is possible to detect both the negative suction pressure and the atmospheric pressure by means of a single pressure detection means. Further, even if the operating condition is suddenly changed to detect the negative suction pressure while the atmospheric pressure is detected by the pressure detection means, the engine control depending on the first engine controlled variable is substantially maintained for a predetermined time period. According to this, any incorrect output signal from the pressure detection means is not employed, so that it is possible to improve the controllability of the engine.

What is claimed is:

1. An engine control system comprising:

means for detecting a throttle opening degree of an engine;

means for detecting a speed of said engine;

means for detecting a pressure which is applied to said pressure detection means;

first operating means for operating a first engine controlled variable on the basis of a throttle opening degree signal from said throttle opening degree detection means and a speed signal from said speed detection means;

second operating means for operating a second engine controlled variable on the basis of a negative suction pressure signal from said pressure detection means and the speed signal from said speed detection means;

means for selecting one of said first engine controlled variable or said second engine controlled variable according to engine conditions;

suction pressure/atmospheric pressure changeover means for introducing to said pressure detection means a) an atmospheric pressure when said selection means selects said first engine controlled variable and b) the negative suction pressure when said selection means selects said second engine controlled variable;

means for detecting atmospheric pressure based on an output from said pressure detection means to which the atmospheric pressure is introduced by means of said changeover means;

means for controlling said engine on the basis of said first or said second engine controlled variable selected by said selection means and the atmospheric pressure detected by said atmospheric pressure detection means; and delay means responsive to said selecting means changing from said first engine controlled variable to said second engine controlled variable, for continuing operation using said first engine controlled variable for a predetermined time after the pressure to be introduced to said pressure detection means is changed over from the atmospheric pressure to the negative suction pressure by means of said suction pressure/atmospheric pressure changeover means.

2. An engine control system according to claim 1, wherein said selection means includes changing means for gradually changing a controlled variable from said first engine controlled variable to said second engine controlled variable.

3. An engine control system comprising:

means for detecting a throttle opening degree of an engine;

means for detecting a speed of said engine;

means for detecting pressure;

first operating means for operating a first engine controlled variable on the basis of a throttle opening degree signal from said throttle opening degree detection means and a speed signal from said speed detection means;

second operating means for operating a second engine controlled variable on the basis of a negative suction pressure signal from said pressure detection means and the speed signal from said speed detection means;

means for selecting said first engine controlled variable or said second engine controlled variable according to engine conditions;

suction pressure/atmospheric pressure changeover means for introducing to said pressure detection means the atmospheric pressure when said selection means selects said first engine controlled variable and the negative suction pressure when said selection means selects said second engine controlled variable;

means for detecting atmospheric pressure based on output from said pressure detection means to which the atmospheric pressure is introduced by means of said changeover means;

means for controlling said engine on the basis of said first or said second engine controlled variable selected by said selection means and the atmospheric pressure detected by said atmospheric pressure detection means; and means for serving to gradually execute the change from said first engine controlled variable to said second engine controlled variable when pressure to be introduced to said pressure detection means by means of said suction pressure/atmospheric pressure changeover means is changed over from the atmospheric pressure to the negative suction pressure.

4. An engine control system according to claim 3, wherein said selection means includes changing means to for gradually changing a controlled variable from said first engine controlled variable to said second engine controlled variable.

5. An engine control system comprising:

means for detecting a parameter related to an amount of suction air to be sucked into an engine;

means for detecting a speed of said engine;

means for detecting the pressure;

first operating means for operating a first engine controlled variable on the ,basis of a suction air signal from said suction air parameter detection means and a speed signal from said speed detection means;

second operating means for operating a second engine controlled variable on the basis of a negative suction pressure signal from said pressure detection means and the speed signal from said speed detection means;

means for selecting said first engine controlled variable or said second engine controlled variable according to engine conditions;

suction pressure/atmospheric pressure changeover means for introducing to said pressure detection means the atmosphere pressure when said selection means selects said first engine controlled variable and the negative suction pressure when said selection means selects said second engine rolled variable;

means for detecting atmospheric pressure based on output from said pressure detection means to which the atmospheric pressure is introduced by means of said changeover means;

means for controlling said engine on the basis of said first or said second engine controlled variable selected by said selection means and the atmospheric pressure detected by said atmospheric pressure detection means; and delay means making said selection means to select said second engine controlled variable after said selection means has been made to continue to select said first engine controlled variable for a predetermined time period from the time when the pressure to be introduced to said pressure detection means is changed over from the atmospheric pressure to the negative suction pressure by means of said suction pressure/atmospheric pressure changeover means.

6. An engine control system according to claim 5, wherein said selection means includes changing means for gradually changing a controlled variable from said first engine controlled variable to said second engine controlled variable.

7. An engine control system according to claim 5, wherein said suction air detecting means detects one of an actual opening degree of a throttle valve or a value of an intake air.

8. An engine control system comprising:

means for detecting a parameter related an amount of suction air to be sucked into an engine;

means for detecting a speed of said engine;

means for detecting the pressure;

first operating means for operating a first engine controlled variable on the basis of a suction air signal from said suction air parameter detection means and a speed signal from said speed detection means;

second operating means for operating a second engine controlled variable on the basis of a negative suction pressure signal from said pressure detection means and the speed signal from said speed detection means;

means for selecting said first engine controlled variable or said second engine controlled variable according to engine conditions;

suction pressure atmospheric pressure changeover means for introducing to said pressure detection means the atmospheric pressure when said selection means selects said first engine controlled variable and the negative suction pressure when said selection means selects said second engine controlled variable;

means for detecting atmospheric pressure based on output from said pressure detection means to which the atmospheric pressure is introduced by means of said changeover means;

means for controlling said engine on the basis of said first or said second engine controlled variable selected by said selection means and the atmospheric pressure detected by said atmospheric pressure detection means; and means for serving to gradually execute the change from said first engine controlled variable to said second engine controlled variable when pressure to be introduced to said pressure detection means by means of said suction pressure/atmospheric pressure changeover means is changed over from the atmospheric pressure to the negative suction pressure.

9. An engine control system according to claim 2, wherein said changing means changes a controlled variable which is determined by combining weighted first engine controlled variable and weighted second engine controlled variable.

10. An engine control system according to claim 1, wherein said predetermined time period of said delay means is counted based on a revolution number of said engine.

11. An engine control system according to claim 1, wherein said first and said second controlled variables are fuel injection rates.

12. An engine control system comprising:

first means for detecting a pressure of at least one of a negative suction pressure and an atmospheric pressure;

second means for detecting at least one operating value of said engine related to an amount of suction air other than said negative suction pressure;

means for controlling said engine on the basis of parameters from said first and second means;

changeover means, receiving said negative suction pressure and said atmospheric pressure, for selecting one of said negative suction pressure and said atmospheric pressure as said pressure to be applied to said first means;

controlling means, for:

1) detecting whether the engine is in a first condition which requires control using a first process that uses said negative suction pressure as a sensed parameter, or a second condition which requires control using a second process that uses said at least one operating value as a sensed parameter, 2) making a calculation using said sensed parameter, and correcting a result of said calculation using said atmospheric pressure, 3) controlling said engine to use said second process when said second condition is detected, and controlling said changeover means to apply atmospheric pressure to said first means during at least a part of said second condition, and 4) detecting said first condition and controlling said changeover means to apply negative suction pressure to said first means and delaying for a predetermined time period after that, and only then controlling said engine to use said first process condition.

13. An engine control system according to claim 12, wherein said second means includes means responsive to a speed of said engine.

* * * * *